United States Patent [19]

Fahey

[11] 4,449,335

[45] May 22, 1984

[54] ROOF FRAMING SYSTEM

[76] Inventor: Patrick Fahey, 2609 W. 52nd St., Minneapolis, Minn. 55410

[21] Appl. No.: 384,745

[22] Filed: Jun. 3, 1982

[51] Int. Cl.[3] ..... E04B 7/02; E04B 1/38

[52] U.S. Cl. ..... 52/90; 52/713

[58] Field of Search ..... 52/90, 92, 79.5, 639, 52/641, 713, 715

[56] References Cited

U.S. PATENT DOCUMENTS

| | | | |
|---|---|---|---|
| 381,137 | 4/1888 | Hodges | 52/639 |
| 2,477,163 | 7/1949 | Garnett | 52/639 |
| 2,629,906 | 3/1953 | Holmes | 52/639 |
| 2,768,434 | 10/1956 | Taylor | 52/639 |
| 2,937,418 | 5/1960 | Sanford | 52/639 |
| 2,947,119 | 8/1960 | Puckett, Jr. | 52/713 |
| 3,144,733 | 8/1964 | Balinski | 52/715 |
| 3,333,875 | 8/1967 | Tracy | 52/92 |
| 3,363,373 | 1/1968 | Huss, Jr. | 52/715 |
| 3,423,898 | 1/1969 | Tracy et al. | 52/713 |
| 3,596,941 | 8/1971 | Tracy | 52/713 |
| 3,861,104 | 1/1975 | Bower | 52/713 |
| 3,964,218 | 6/1976 | Ho | 52/90 |
| 4,198,175 | 4/1980 | Knepp et al. | 52/702 |
| 4,261,143 | 4/1981 | Rizzo | 52/92 |
| 4,335,555 | 6/1982 | Southerland et al. | 52/639 |

*Primary Examiner*—John E. Murtagh

*Assistant Examiner*—Andrew Joseph Rudy

[57] ABSTRACT

A roof framing system consisting of an apex bracket and two bracket assemblies, each bracket assembly consisting of a rafter bracket and sill plate bracket. The apex bracket has two U-shaped sections joined by a bendable intermediate section. The U-shaped sections grasp the upper end of a pair of opposing rafters, while the bendable section accommodates the desired pitch of the roof. The rafter bracket has a U-shaped section for grasping the lower end of a rafter bracket and has two arms separated by a distance sufficient to allow a rafter to be disposed therebetween. The sill plate bracket has a right-angled section for mounting a top sill plate and has two arms separated by a distance sufficient to allow a rafter to be disposed therebetween. The sill plate bracket's arms receive and support the rafter bracket's arms, thereby allowing opposing rafters to be mounted at their lower end and subsequently to be rotated towards the apex of the roof for joining by the apex bracket.

2 Claims, 4 Drawing Figures

ROOF FRAMING SYSTEM

BACKGROUND OF THE INVENTION

1. Field of the Invention

This invention relates generally to an improvement in the construction of the frame structure of roofs. This invention relates particularly to the construction of a roof frame by use of an adjustable bracket system whereby relatively unskilled workmen can erect a frame structure in a minimum of time.

2. Description of the Prior Art

Roof structures have been constructed in various ways, including construction involving precutting and fitting together timber by skilled workmen. Many construction aids have been developed to assist in the computation and precutting of the timbers. Such devices, however, often have been so complicated or expensive that an average workman either could not understand their operation or could not afford them. Such devices, while aiding in the precutting of timber, nevertheless did not generally aid in the actual placement of the precut timbers into the roof structure.

Some prior art roof framing systems seek to avoid any precutting of timber, such as that disclosed in U.S. Pat. No. 3,422,898, but unfortunately involve the use of complex adjustable brackets which themselves might require preadjustment. Such prior art roof framing systems also do not aid sufficiently in the placement of the timbers into the roof structure.

SUMMARY OF THE INVENTION

The present invention is a roof framing system which allows easy assembly of a roof frame. The roof framing system comprises an apex bracket and two bracket assemblies, each bracket assembly comprising a rafter bracket and a sill plate bracket.

The apex bracket comprises first means for grasping the upper end of a first rafter, second means for grasping the upper end of a second rafter, and means for setting the pitch between said first and second rafters. The apex bracket is illustrated by a bracket having two U-shaped sections joined by a bendable intermediate section. The U-shaped sections grasp the upper ends of a pair of rafters, while the bendable section accomodates the desired pitch of the roof. Each U-shaped section has nail holes to facilitate grasping the top end of a rafter.

The rafter bracket comprises means for grasping the lower end of a rafter and two arms separated by a distance sufficient to allow a rafter to be disposed therebetween, the arms adjustably extending from the lower end grasping means. The rafter bracket is illustrated by a bracket having a U-shaped section and two arms separated by a distance sufficient to allow a rafter to be disposed therebetween. The ends of the arms may be bent upon themselves to form lips. The U-shaped section may have nail holes for grasping the lower end of a rafter.

The sill plate bracket comprises means for grasping a top sill plate, two arms separated by a distance sufficient to allow a rafter to be disposed therebetween, the arms adjustably extending from the grasping means, and means connected to each of the arms for receiving and supporting the two arms of the rafter bracket. The sill plate bracket may be illustrated by a bracket having a right-angled section for mounting upon a top sill plate at its upper outer edge and two arms separated by a distance sufficient to allow a rafter to be disposed therebetween. The ends of the arms may have a bend complementary in shape to the rafter bracket's lips in order to receive such lips and thereby provide support of the rafter bracket. The right-angled section also may have nail holes to facilitate grasping the top sill plate. The apex bracket, rafter brackets, and sill plate brackets each may have a sight-hole.

The roof framing system allows easy adjustment in order to accomodate the desired pitch of a roof. For example, after joining a first pair of rafters, whether such first pair of rafters constitutes the beginning of a new roof or merely an extension of an existing roof, the pitch of the apex is measured by the angle of bend of the apex bracket and the position of the apex bracket on opposing rafters is located by sight-holes. This allows prebending the remaining yet to be used apex brackets to the appropriate angle and by use of sight-holes an apex bracket may be properly attached to one rafter of each pair of opposing rafters. Also, after joining a first pair of rafters, the position of the respective rafter brackets and sill plate brackets on rafters and top sill plates are noted. The proper adjustment and alignment of the extended arms of the rafter and sill plate brackets are also noted. By use of sight-holes the rafter and sill plate brackets may be properly attached to the lower end of rafters and the top sill plates. The arms of the rafter brackets and sill plate brackets may be preadjusted and aligned so that the sill plate bracket receives and supports the rafter bracket. With sill plate brackets supporting their respective rafter brackets, two rafters may be rotated towards one another, resulting in the predetermined pitch, and the apex bracket, fastened to one of the rafters, may be fastened to the other bracket.

DESCRIPTION OF THE PREFERRED EMBODIMENT

Figures 1, 2, 3, 4:
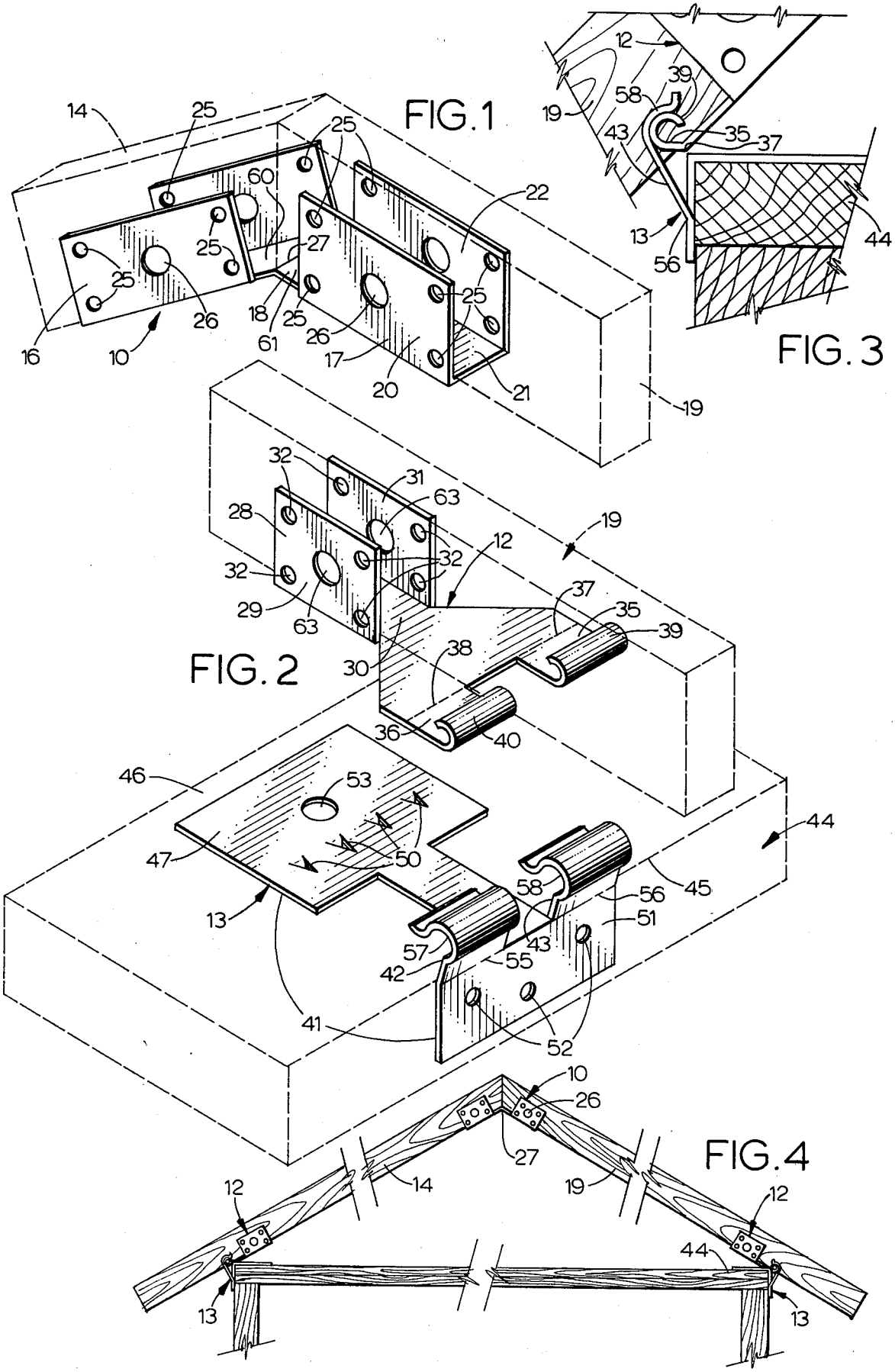
FIG. 1 is a perspective view showing an apex bracket with the outline of the upper ends of two opposing rafters.
FIG. 2 is a perspective view showing a rafter bracket and a sill plate bracket with the outlines respectively of the lower end of a rafter and a top sill plate.
FIG. 3 is a cross-sectional view showing a rafter bracket as received and supported by a sill plate bracket.
FIG. 4 is a side view of a roof structure showing an apex bracket, opposing rafters, and a pair of rafter brackets and sill plate brackets.

In its preferred embodiment, the roof framing system comprises an apex bracket 10 and two bracket assemblies, each bracket assembly comprising a rafter bracket 12 and a sill plate bracket 13.

Referring to FIG. 1, apex bracket 10 as two U-shaped sections 16 and 17 joined by a bendable intermediate section 18. U-shaped sections 16 and 17 are capable of grasping the upper ends of a pair of rafters, while bendable intermediate section 18 is capable of accomodating the desired pitch of a roof.

U-shaped section 17, for example, is capable of receiving the upper end of a rafter such as rafter 19 by virtue of the generally U-shape formed by faces 20, 21, and 22 of U-shaped section 17. By adjusting the distance between faces 20 and 22 relative to the thickness of rafter 19, U-shaped section 17 will grasp the upper end of rafter 19 without the need for nails or screws. This presumes that U-shaped section 17 is constructed of a sufficiently rigid material. In the preferred embodiment, however, faces 20 and 22 are provided with apertures 25 for securing U-shaped section 17 to rafter 19 by use of nails or screws. Face 20 of U-shaped section 17 has sight-hole 26. U-shaped section 16 is similarly constructed.

Bendable intermediate section 18 is shown in FIG. 1 to accomodate the pitch between rafters 14 and 19 by a single bend along line 27. Portion 60, which lies between U-shaped section 16 and bend line 27, is designed to lie flat against the underside of precut rafter 14. Similarly, portion 61, which lies between U-shaped section 17 and bend line 27, is designed to lie flat against the underside of precut rafter 19. Of course, in alternative embodiments the angle or pitch between U-shaped section 16 and 17 may be formed in any number of ways, including the use of more than one bend line or by bending section 18 to form a continuous curve.

Referring to FIG. 2, rafter bracket 12 has generally U-shaped section 28 for receiving the lower end of rafters such as rafter 19. U-shaped section 28 has faces 29, 30, and 31, which receive rafter 19. When constructed of sufficiently rigid material, U-shaped section 28 is capable of receiving and grasping rafter 19 by adjusting the distance between faces 29 and 31 relative to the thickness of rafter 19. In the preferred embodiment, however, faces 29 and 31 have apertures 32 for securing U-shaped section 28 to rafter 19 by use of nails or screws. Face 29 of section 28 has sight hole 63.

Rafter bracket 12 further has arms 35 and 36 which are separated by a distance greater than the thickness of rafter 19 thereby allowing rafter 19 to be disposed between arms 35 and 36. Arms 35 and 36 extend from generally U-shaped section 28 and in the preferred embodiment are adjustable along bend lines 37 and 38 respectively. Lips 39 and 40 are formed by bending respectively arms 35 and 36 back upon themselves. Rafter 19 will be disposed between lips 39 and 40 upon appropriate bending along lines 37 and 38.

In reference to FIG. 2, sill plate 13 has right-angled section 41 for mounting upon a top sill plate such as top sill plate 44. Right-angled section 41 is mounted upon top sill plate 44 at its upper outer edge 45. Portion 47 of right-angled section 41 is designed to contact the upper face of a top sill plate such as upper face 46. Portion 47 of right-angled section 41 has downwardly projecting self-nailers 50 which press into upper face 46 when, for example, portion 41 is hammered into upper face 46. Portion 51 of right-angled section 41 has apertures 52 for securing right-angled section 41 to top sill plate 44 by use of nails or screws. Portion 47 of right-angled section 41 has sight-hole 53.

Arms 42 and 43 are separated by a distance relative to the width of rafter 19 sufficient to allow rafter 19 to be disposed therebetween. Arms 42 and 43 may be adjusted by bending along lines 55 and 56 respectively. Bends 57 and 58 in arms 42 and 43 are complementary in shape to rafter bracket lips 39 and 40. FIG. 2 shows the preferred embodiment of bends 57 and 58, while FIG. 3 shows an alternative embodiment of bend 58 and 57 (not shown). As shown in FIG. 3, rafter bracket 12 is grasping the lower end of rafter 19, while sill plate bracket 13 is grasping top sill plate 44. Bend 58 of arm 43 of sill plate bracket 13 is complementary in shape to lip 39 of arm 35 of rafter bracket 12. By appropriate adjustment by virtue of bends along line 37 of arm 35 and along line 56 of arm 43, lip 39 is received and supported by bend 58 in arm 43. Thus, rafter 19 is generally pivotally mounted onto top sill plate 44.

With reference to FIGS. 3 and 4, the roof framing system allows easy adjustment in order to accomodate the desired pitch of a roof. After joining a first pair of rafters 14 and 19, the pitch of the apex is measured by the angle of bend along line 27 of apex bracket 10 and the position of the apex bracket on rafter 19 is located by sight-hole 26. This allows prebending the remaining yet to be used apex brackets to the appropriate angle and by use of such sight-holes an apex bracket may be properly attached to one rafter of each pair of opposing rafters added to the roof structure. Also, after joining a first pair of rafters, the position of the respective rafter bracket 12 and sill plate bracket 13 on rafter 19 and top sill plate 44 are noted. The proper adjustment and alignment of extended arms 35 and 36 of rafter bracket 12 and arms 42 and 43 of sill plate bracket 13 are also noted by use of sight-holes 63 and 53 and yet to be used rafter brackets and sill plate brackets may be properly attached to additional rafters and top sill plates. The arms of such yet to be added rafter brackets and sill plate brackets may be preadjusted and aligned by bending at lines 37 and 38 of rafter bracket 12 and lines 55 and 56 of sill plate bracket 13 so that the sill plate bracket receives and supports the rafter bracket as shown in FIG. 3. With sill plate brackets supporting their respective rafter brackets, two rafters may be rotated towards one another, resulting in the predetermined pitch, and the apex bracket, fastened to one of the rafters, may be fastened to the other rafter to complete construction of that portion of the roof frame.

The above description of the preferred embodiment is somewhat specific. Those skilled in the art will perceive modifications which can be made in the preferred embodiment without departing from the spirit of the invention. Accordingly, the appended claims are intended to cover all such embodiments and operations according to the true spirit and scope of the invention.

I claim:

1. A roof framing system for a roof having a plurality of rafters extending between top sill plates, each rafter having upper and lower ends, comprising the combination of an apex bracket, the apex bracket comprising a first section for grasping the upper end of a first rafter, a second section for grasping the upper end of a second rafter, and an intermediate section operably coupling said first and second sections for setting the pitch between said first and second rafters, and two bracket assemblies, each bracket assembly comprising a rafter bracket and a sill plate bracket, the rafter bracket comprising a rafter grasping section and two arms adjustably extending from said rafter grasping section, said arms being separated by a distance sufficient to allow one of said rafters to be disposed therebetween, and each arm including an outermost section comprising a lip formed by bending said arm back upon itself, and the sill plate bracket comprising a mounting section for grasping one of said top sill plates, two arms adjustably extending from said mounting section, said arms separated by a distance sufficient to allow one of said rafters to be disposed therebetween, and a rafter bracket receiving section connected to each of said arms for detachably receiving said rafter bracket lips.

2. The roof framing system of claim 1 wherein said rafter bracket receiving section connected to each of said sill plate bracket arms comprises a bend in the sill plate bracket's arm complementary in shape to the rafter bracket's lips.

* * * * *